US007714799B2

(12) United States Patent
Hsu et al.

(10) Patent No.: US 7,714,799 B2
(45) Date of Patent: May 11, 2010

(54) ANTENNA DEVICE AND WIRELESS SIGNAL TRANSMISSION DEVICE WITH THE SAME

(75) Inventors: Chia-Wen Hsu, Taipei (TW); Fang-Yen Sung, Taipei (TW); Yu-Liang Chu, Taipei (TW); Wan-Li Wang, Taipei (TW); Tsung-Wen Chiu, Taipei (TW); Fu-Ren Hsiao, Taipei (TW)

(73) Assignee: Advanced Connectek Inc., Taipei (TW)

( * ) Notice: Subject to any disclaimer, the term of this patent is extended or adjusted under 35 U.S.C. 154(b) by 184 days.

(21) Appl. No.: 12/128,626

(22) Filed: May 29, 2008

(65) Prior Publication Data

US 2008/0316119 A1 Dec. 25, 2008

(30) Foreign Application Priority Data

Jun. 23, 2007 (TW) ..... 96122767 A

(51) Int. Cl.
*H01Q 1/50* (2006.01)
*H01Q 1/24* (2006.01)

(52) U.S. Cl. ..... 343/906; 343/702; 439/916

(58) Field of Classification Search ..... 343/906, 343/702, 878, 880, 882, 900, 901; 439/916
See application file for complete search history.

(56) References Cited

U.S. PATENT DOCUMENTS

| | | | | |
|---|---|---|---|---|
| 5,926,138 | A * | 7/1999 | Eerikainen | 343/702 |
| 7,195,520 | B1 * | 3/2007 | Huang | 439/638 |
| 7,400,301 | B2 * | 7/2008 | Chan | 343/702 |
| 2008/0122730 | A1 * | 5/2008 | Lin | 343/878 |

* cited by examiner

*Primary Examiner*—Hoang V Nguyen
(74) *Attorney, Agent, or Firm*—Jianq Chyun IP Office

(57) ABSTRACT

An antenna device comprises a base, a combination element, a fixing element, a rotation unit, and a radiation conductor. The base has a through hole and a bottom surface. The bottom surface has a plurality of pins, and the through hole is approximately parallel to the bottom surface. The combination element has a first blocking portion. The fixing element has an embedding surface, wherein the embedding surface is surrounded by a plurality of metal plates. The first blocking portion touches one terminal of the fixing element. The rotation unit has a second blocking portion, and the second blocking portion touches the other terminal of the fixing element. The other terminal of rotation unit pivoted at the radiation conductor. The fixing element wedges with close in the inner of the through hole of the base. Therefore, the antenna device is formed a firm structure.

14 Claims, 3 Drawing Sheets

ANTENNA DEVICE AND WIRELESS SIGNAL TRANSMISSION DEVICE WITH THE SAME

CROSS-REFERENCE TO RELATED APPLICATION

This application claims the priority benefit of Taiwan application serial no. 96122767, filed on Jun. 23, 2007. The entirety of the above-mentioned patent application is hereby incorporated by reference herein and made a part of this specification.

BACKGROUND OF THE INVENTION

1. Field of the Invention

The present invention relates to an antenna device, and more particularly, to a combination structure of antenna device with an embedding surface of a fixing element, which is an expansive and hollow cylinder.

2. Description of Related Art

As the global communication business develops rapidly, the wireless mobile communication technique as a principle mean of personal communication in the future causes great concern. Because of the complexity of the wireless communication technique, the industries must provide best combination products. No matter the appearance of appreciation of the beauty or the effects of transmitting and receiving signals will decide the key factor of products on sale. Especially, the improvement on the external structure of the external components of the hardware for the antenna is an important mission for the designers of the corresponding organizations to make a breakthrough.

For increasing the strength of the combination structure for the antenna module, the American patent NO. U.S. Pat. No. 7,195,520 'Connector for antenna', as an example, uses a C-shaped mounted between a hollow casing and a terminal. Although the structure of the antenna is simple, the components can not be shifted to the front and rear, and the antenna can not be retrieved either. So the precision for fabricating is not easy to control. One of the other references uses the improvement of an adapter to lower the risk of the damage to the antenna during taking the antenna apart. But the antenna can not be retrieved in the inner of the transceiver causing inconvenience on carrying. It is very inconvenient to re-fabricate the antenna at the usage state.

So it is desired to develop an antenna device with convenient carrying, easy retrieving, simple structure, and low cost.

SUMMARY OF THE INVENTION

The present invention provides an antenna device and a wireless signal transmission device with the same. The antenna device has more stability and can be retrieved easily.

The antenna device comprises a base, a combination element, a fixing element, a rotation unit, and a radiation conductor. The base has a through hole and a bottom surface, wherein the bottom surface has a plurality of pins. The combination element is approximated to a cylinder and has a first blocking portion. The fixing element is a hollow cylinder and includes an embedding surface, wherein the embedding surface contains a plurality of bar troughs paralleling to each other, and one terminal of the fixing element touches the first blocking portion. The rotation unit is approximated to a cylinder and includes a second blocking portion, wherein the second blocking portion touches the other terminal of the fixing element, and one terminal of the rotation unit and the combination element wedge to each other via the fixing element. One terminal of the radiation conductor and the other terminal of the rotation unit are pivoted together.

According to an embodiment of the invention, a metal plate is formed between every two bar troughs. The first blocking portion and the second blocking portion hold and press both side of the fixing element to form an expanding type of embedding surface. Thus, the plurality of metal plates forms an arched structure and maintains a constant elasticity to wedge with close in the inner of the through hole of the base. Therefore, the antenna device is formed a firm structure.

According to another embodiment of the invention, a wireless signal transmission device with the antenna device further includes a wireless signal transmission apparatus, a substrate, a feeding cable, and a ground surface. The radiation conductor of the antenna device is easy to pull out and retrieve in the through hole of the base. So the convenience of the wireless signal transmission device is increased.

In order to make the features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
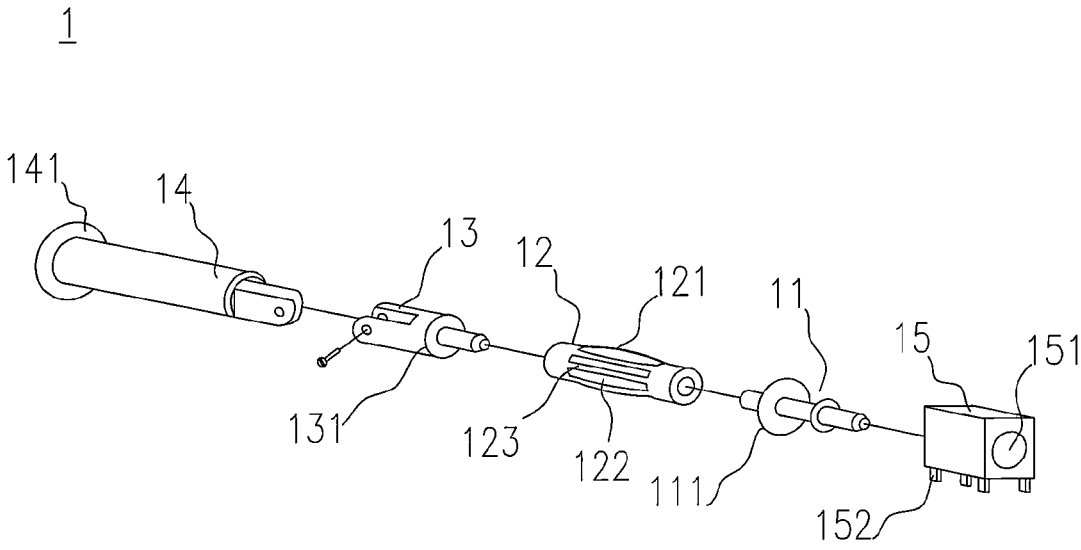
FIG. 1 is a solid decomposition diagram of an antenna device according to an embodiment of the invention.

Reference will now be made in detail to the present embodiments of the invention, examples of which are illustrated in the accompanying drawings. Wherever possible, the same reference numbers are used in the drawings and the description to refer to the same or like parts.

Figure 2:
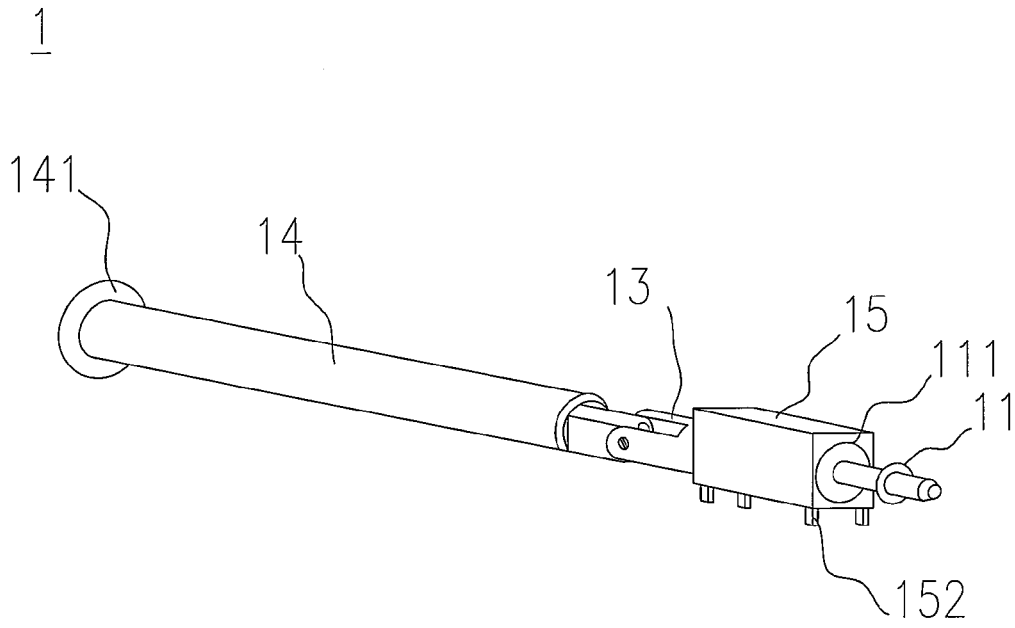
FIG. 2 is a solid composition diagram of an antenna device according to an embodiment of the invention.

FIG. 1 and FIG. 2 are respectively a solid decomposition and composition diagram of an antenna device according to an embodiment of the invention. Referring to FIG. 1 and FIG. 2 together, the antenna device 1 comprises: a base 15, a combination element 11, a fixing element 12, a rotation unit 13, and a radiation conductor 14. The base 15 has a through hole 151 and a bottom surface (not shown in FIG. 1 and FIG. 2), and a plurality of pins 152 is disposed on the bottom surface. The through hole 151 is approximately parallel to the bottom surface. The length of the base 15 is about 8.5 mm, the width of the base 15 is about 7 mm, and the height of the base 15 is about 7 mm. The diameter of the through hole 151 is about 4 mm. The length of the pins 152 is about 1 mm, the width of the pins 152 is about 1 mm, and the height of the pins 152 is about 1.5 mm.

The combination element 11 is approximated to a cylinder and includes a first blocking portion 111. The length of the combination element 11 is about 7 mm, the diameter of the combination element 11 is about 2 mm. The depth of the first blocking portion 111 is about 0.5 mm, the diameter of the first blocking portion 111 is about 3.5 mm. The fixing element 12 is a hollow cylinder and includes an embedding surface 121, wherein the embedding surface 121 contains a plurality of bar troughs 122 paralleling to each other. A metal plate 123 is formed between every two bar troughs 122. One terminal of the fixing element 12 touches the first blocking portion 111. The length of the fixing element 12 is about 6 mm, and the diameter of the fixing element 12 is about 3.5 mm.

The length of the embedding surface 121 is about 6 mm and is surrounded by the plurality of metal plates 123. The diameter of the two terminals forming a circle of the embedding surface 121 is about 3 mm, the biggest diameter of the middle of the embedding surface 121 is about 4.5 mm. The rotation unit 13 is approximated to a cylinder and includes a second blocking portion 131, wherein the second blocking portion 131 touches the other terminal of the fixing element 12. One terminal of the rotation unit 13 and the combination element 11 wedge to each other via the fixing element 12. The other terminal of the rotation unit 13 is pivoted at one terminal of the radiation conductor 14. The length of the rotation unit 13 is about 7 mm, the diameter of the rotation unit 13 is about 3.5 mm, and the diameter of the second blocking portion is about 3.5 mm.

A blocking portion 141 is disposed at the end of the other terminal of the radiation conductor 14. The length of the radiation conductor 14 is about 68 mm, and the diameter of the radiation conductor 14 is about 3.5 mm. The diameter of the blocking portion 141 is about 5 mm, and the depth of the blocking portion 141 is about 1 mm.

In the embodiment, the first blocking portion 111 and the second blocking portion 131 hold and press both side of the fixing element 12 to form an expanding type of embedding surface 121. Thus, the plurality of metal plates 123 forms a arched structure and maintains a constant elasticity to wedge with close in the inner of the through hole 151 of the base 15. Therefore, the antenna device 1 is formed a firm structure.

By the above mentioned note of antenna device 1, the embedding surface 121 is surrounded by the plurality of metal plates 123 disposed on the surface of the fixing element 12, and the external perimeter of the embedding surface 121 is formed expansive cylinder by the holding and pressing effect of the first blocking portion 111 and the second blocking portion 131. When the fixing element 12 is put in the through hole 151 of the base 15, the embedding surface 121 is wedged with close in the inner of the through hole 151 of the base 15 by the expansive effect to increase the stability of the structure of the antenna device 1. So the components of the antenna device 1 are not easy to drop for the external force. Besides, a blocking portion 141 is disposed at the end of the other terminal of the radiation conductor 14, and the surface of the blocking portion 141 is a conical convexity for easing to draw out and push in the fixing element 12, the rotation unit 13, and the radiation conductor 14 from the base 15. Thus, the convenience of using and retrieving the antenna device 1 is increased.

Figure 3:
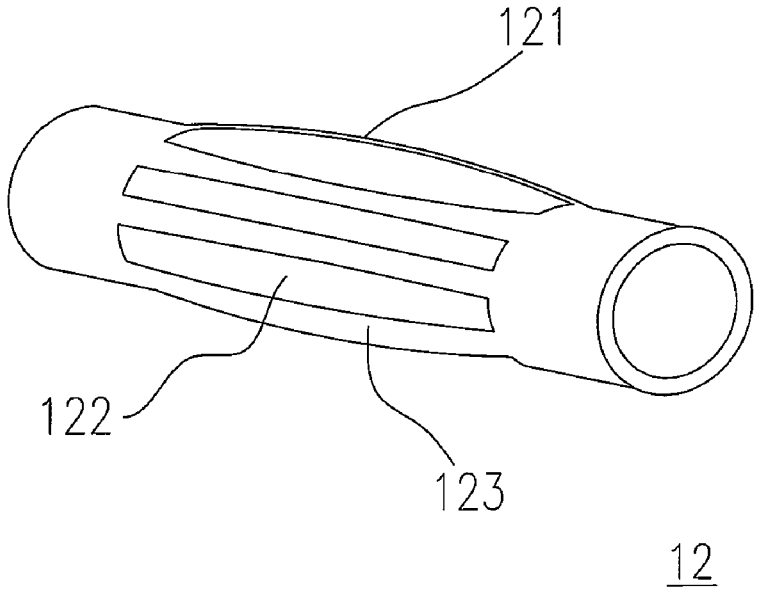
FIG. 3 is a solid diagram of a fixing element.
Figure 4:
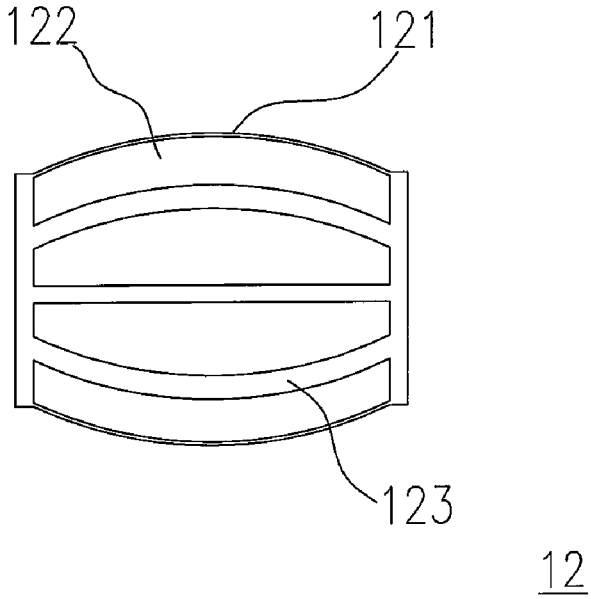
FIG. 4 is a lateral diagram of a fixing element.

FIG. 3 and FIG. 4 are respectively a solid and lateral diagram of the fixing element 12. Referring to FIG. 3 and FIG. 4 together, the embedding surface 121 disposed on the surface of the fixing element 12 includes the plurality of bar troughs 122 paralleling to each other, and the metal plate 123 is formed between every two bar troughs 122. Because of the expansive property of the metal plate 123, the fixing element 12 is suitable to get in and out of the inner of the through hole 151 of the base 15 repeatedly. The diameter of the end of the two terminals of the fixing element is smallest, and the diameter of the middle of the fixing element is biggest.

When the antenna device 1 is at usage state, the fixing element 12 is put in the through hole 151 of the base 15, the embedding surface 121 and the inner surface of the through hole 151 touch with close to increase the binding stability of radiation conductor 14 and the base 15. When the antenna device 1 is at retrieving stage, the radiation conductor 14 is pushed and pressed via the base 15 by shrinking the expansive property of the metal plates 123 of the embedding surface 121. The retrieving action of the antenna device 1 is achieved easily and quickly to increase the convenience of usage and retrieving. So, the antenna device 1 is a simple structure, easy to produce with low cost.

Figure 5:
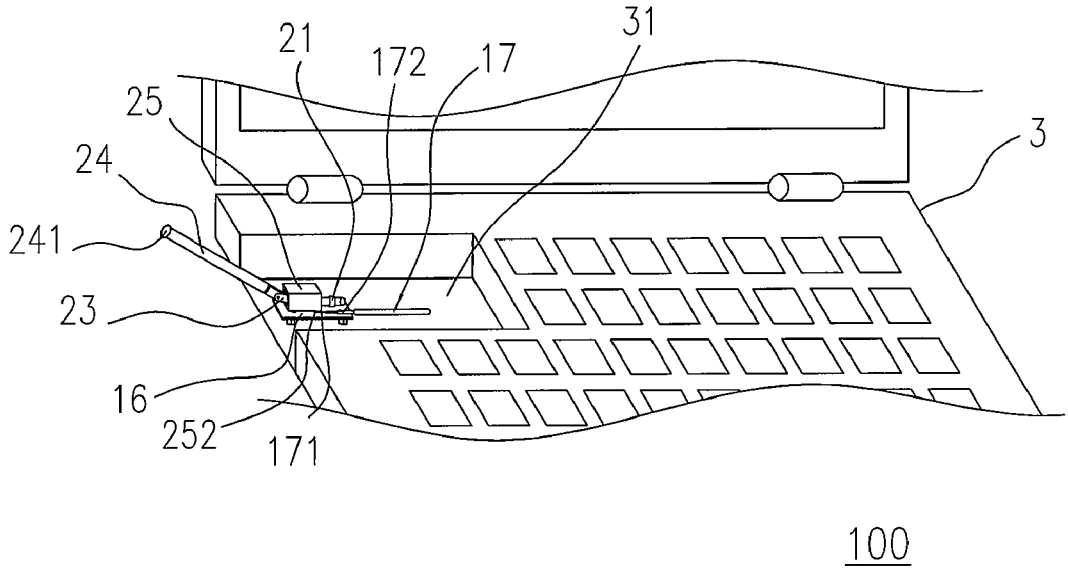
FIG. 5 is a solid diagram at usage state implementing to a wireless signal transmission device according to an embodiment of the invention.
Figure 6:
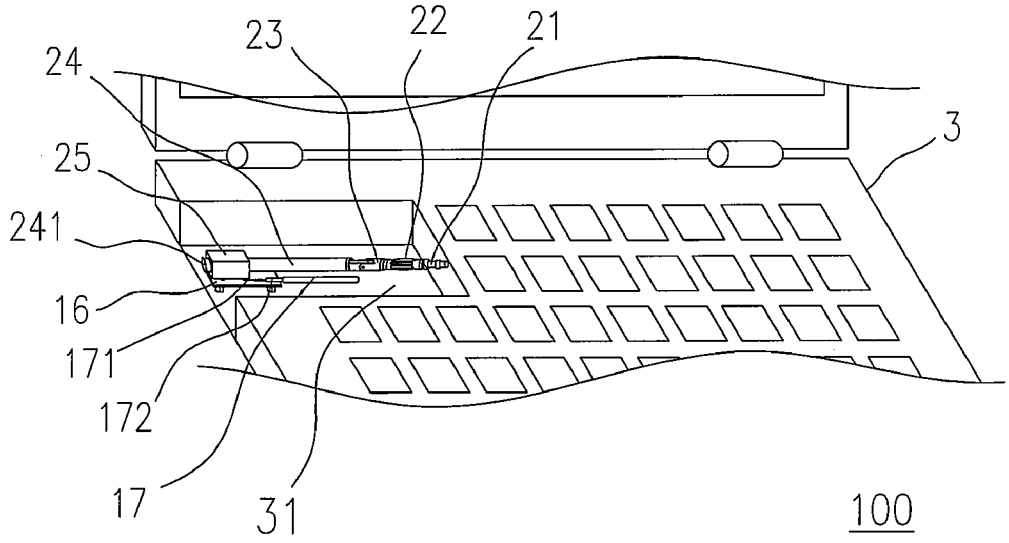
FIG. 6 is a solid diagram at retrieving state implementing to a wireless signal transmission device according to an embodiment of the invention.

FIG. 5 and FIG. 6 are respectively a solid diagram at usage state and a solid diagram at retrieving stage implementing to a wireless signal transmission device according to an embodiment of the invention. Referring to FIG. 5 and FIG. 6 together, the wireless signal transmission device 100 includes a wireless signal transmission apparatus 3, an antenna device 2, a substrate 16, a feeding cable 17, and a ground surface 31. The antenna device 2 is the same as the antenna device 1 and works as the antenna device 1. The wireless signal transmission apparatus 3 is a notebook computer as an example here. The antenna device 2 is integrated into the wireless signal transmission apparatus 3. The plurality of pins 252 disposed on the bottom surface of the base 25 is welded at the surface of the substrate 16, and the substrate 16 is welded at the ground surface 31 in the wireless signal transmission apparatus 3. The feeding cable 17 includes a positive conducting cable 171 and a negative conducting cable 172. The positive conducting cable 171 is connected to the pins 152, and the negative conducting cable 172 is connected to the substrate 16. When the antenna device 2 is at the usage state, the radiation conductor 24 is pull out by the conical convexity of the blocking portion 241, and rotation unit 23 is used to rotate the radiation conductor 24 to a suitable position for transmitting and receiving wireless signals. At present, the structure of the antenna device 2 is firm enough by the embedding surface 221 of the fixing element 22 wedged in the inner surface of the through hole 251 of the base 25. When the antenna device 2 is at the retrieving state, the radiation conductor 24 is put into the wireless signal transmission apparatus 3 by pushing and pressing the blocking portion 241. No matter the antenna device 2 is at the usage or the retrieving stage, the antenna device 2 is convenient to pull out and push in. And the antenna device 2 does not occupy space when the antenna device 2 is at the retrieving state.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. An antenna device, comprising:

a base, having a through hole and a bottom surface, wherein the bottom surface has a plurality of pins;

a combination element, approximated to a cylinder and having a first blocking portion;

a fixing element, being a hollow cylinder and including a embedding surface, wherein the embedding surface contains a plurality of bar troughs paralleling to each other, one terminal of the fixing element touches the first blocking portion;

a rotation unit, approximated to a cylinder and including a second blocking portion, wherein the second blocking portion touches the other terminal of the fixing element, one terminal of the rotation unit and the combination element wedge to each other via the fixing element; and a radiation conductor, one terminal of the radiation conductor and the other terminal of the rotation unit are pivoted together.

2. The antenna device as claimed in claim 1, wherein the through hole is approximately parallel to the bottom surface.

3. The antenna device as claimed in claim 1, a metal plate is formed between every two bar troughs of the fixing element.

4. The antenna device as claimed in claim 3, wherein the metal plate is an arched structure.

5. The antenna device as claimed in claim 1, wherein the end of the other terminal of the radiation conductor having a blocking portion.

6. The antenna device as claimed in claim 5, wherein the blocking portion is a conical convexity.

7. A wireless signal transmission device, comprising:

a wireless signal transmission apparatus;

an antenna device, disposed in the wireless signal transmission apparatus;

wherein the antenna device comprises:

a base, having a through hole and a bottom surface, wherein the bottom surface has a plurality of pins;

a combination element, approximated to a cylinder and having a first blocking portion;

a fixing element, being a hollow cylinder and including a embedding surface, wherein the embedding surface contains a plurality of bar troughs paralleling to each other, one terminal of the fixing element touches the first blocking portion;

a rotation unit, approximated to a cylinder and including a second blocking portion, wherein the second blocking portion touches the other terminal of the fixing element, one terminal of the rotation unit and the combination element wedge to each other via the fixing element; and a radiation conductor, one terminal of the radiation conductor and the other terminal of the rotation unit are pivoted together;

a substrate, bearing the base, the plurality of pins at the bottom surface of the base is connected to the substrate;

a feeding cable, including a positive conducting cable and a negative conducting cable, wherein the positive conducting cable is connected to one of the pins, and the negative conducting cable is connected to the substrate; and a ground surface, used to bear the substrate.

8. The wireless signal transmission device as claimed in claim 7, wherein the through hole is approximately parallel to the bottom surface.

9. The wireless signal transmission device as claimed in claim 7, a metal plate is formed between every two bar troughs of the fixing element.

10. The wireless signal transmission device as claimed in claim 9, wherein the metal plate is an arched structure.

11. The wireless signal transmission device as claimed in claim 7, wherein the end of the other terminal of the radiation conductor having a blocking portion.

12. The wireless signal transmission device as claimed in claim 11, wherein the blocking portion is a conical convexity.

13. The wireless signal transmission device as claimed in claim 7, wherein the plurality of pins is connected to the substrate by welding method.

14. The wireless signal transmission device as claimed in claim 7, wherein the wireless signal transmission apparatus is a notebook computer.

* * * * *